US005109788A

United States Patent [19]

Heinzmann

[11] Patent Number: 5,109,788

[45] Date of Patent: May 5, 1992

[54] APPARATUS FOR RECOVERY OF UNMANNED, REUSABLE AIRCRAFT

[75] Inventor: Werner Heinzmann, Bremen, Fed. Rep. of Germany

[73] Assignee: MSG Marine-und Sondertechnik GmbH, Bremen, Fed. Rep. of Germany

[21] Appl. No.: 660,157

[22] Filed: Feb. 21, 1991

Related U.S. Application Data

[63] Continuation of Ser. No. 500,473, Mar. 28, 1990, abandoned.

[30] Foreign Application Priority Data

Apr. 1, 1989 [DE] Fed. Rep. of Germany ..... 3910621

[51] Int. Cl.[5] ..... B63B 35/00

[52] U.S. Cl. ..... 114/261

[58] Field of Search ..... 114/258, 259, 260, 261; 244/100 R, 105, 114 R

[56] References Cited

U.S. PATENT DOCUMENTS

| | | | |
|---|---|---|---|
| 1,128,072 | 2/1915 | Steinmetz | 114/261 |
| 1,774,670 | 9/1930 | Riblet | 114/261 |
| 2,160,449 | 5/1939 | Weichardt et al. | 114/261 |
| 2,342,773 | 2/1944 | Wellman | 114/261 |
| 2,807,429 | 9/1957 | Hawkins et al. | 114/261 |

*Primary Examiner*—Jesûs D. Sotelo
*Assistant Examiner*—Stephen P. Avila
*Attorney, Agent, or Firm*—Toren, McGeady & Associates

[57] ABSTRACT

A flexible surface element is arranged on a vehicle to form a trampoline-like extendable or stretchable receiving or retrieval surface for drones. For this purpose, the surface element is brought out from a gathered-in, folded or pivoted-inward stored, stowed position into a mounted expanded position by means of extendable retention and guidance elements.

1 Claim, 1 Drawing Sheet

APPARATUS FOR RECOVERY OF UNMANNED, REUSABLE AIRCRAFT

This is a continuation of application Ser. No. 07/500,473 filed Mar. 28, 1990, abandoned.

BACKGROUND OF THE INVENTION

The invention relates to an apparatus for recovery of unmanned, reusable aircraft (drones) during a return guidance phase, wherein a landing phase is performed by automatic or remotely controlled arrangements and additional auxiliary means, such as parachute recovery systems.

In returning remotely controlled aircraft used, for instance, for reconnaissance purposes, it is known to conduct the landing by means of a parachute stowed in the aircraft. Herein methods and control systems have become known which make possible a relatively accurate prediction of the landing point, taking into account the existing circumstances. It has, however, been seen that, especially when operating over water, it is relatively difficult to execute a retrieval from the water, since for such a retrieval it is necessary to appropriately sail circling maneuvers with a ship, which requires a large expenditure of time.

SUMMARY OF THE INVENTION

Accordingly, it is an object of the present invention to provide an apparatus which allows a simple recovery of the above-mentioned type of aircraft, which especially permits use on ships and assures reception also under unfavorable environmental conditions such as choppy seas or high waves.

Pursuant to this object. and others which will become apparent hereafter, one aspect of the present invention resides in arranging a flexible surface element as a gathered-in, folded and/or hinged unit stowed in a vehicle, which can be extended and stretched by actuatable bracing and guide elements to form a trampoline-like receiving surface.

This arrangement makes it possible to form a relatively large receiving surface, which does not constitute an encumbrance during the normal operation of the vehicle. Increased touch-down speeds can be utilized because of the trampoline-like receiving surface, and thus targeted homing toward the landing point is much improved.

A particular advantage results when the apparatus is used on ships, since precise orientation cannot be assured because of the state of the seas or waves.

In a preferred embodiment the flexible surface element has a netting construction. 1. In order to enable easy handling, the retention or bracing and guide elements are formed by extendable telescopic arrangements.

Thus an arrangement not impairing the space requirements on a vehicle is created, because the bracing and guidance elements can be extended into the region beyond the stern, in case the apparatus is placed upon ships.

The bracing and guidance elements can be arranged so as to be outwardly extendable and foldable in sideways and longitudinal directions, for the formation of the touchdown surface, so as to create a large retrieval or receiving surface.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
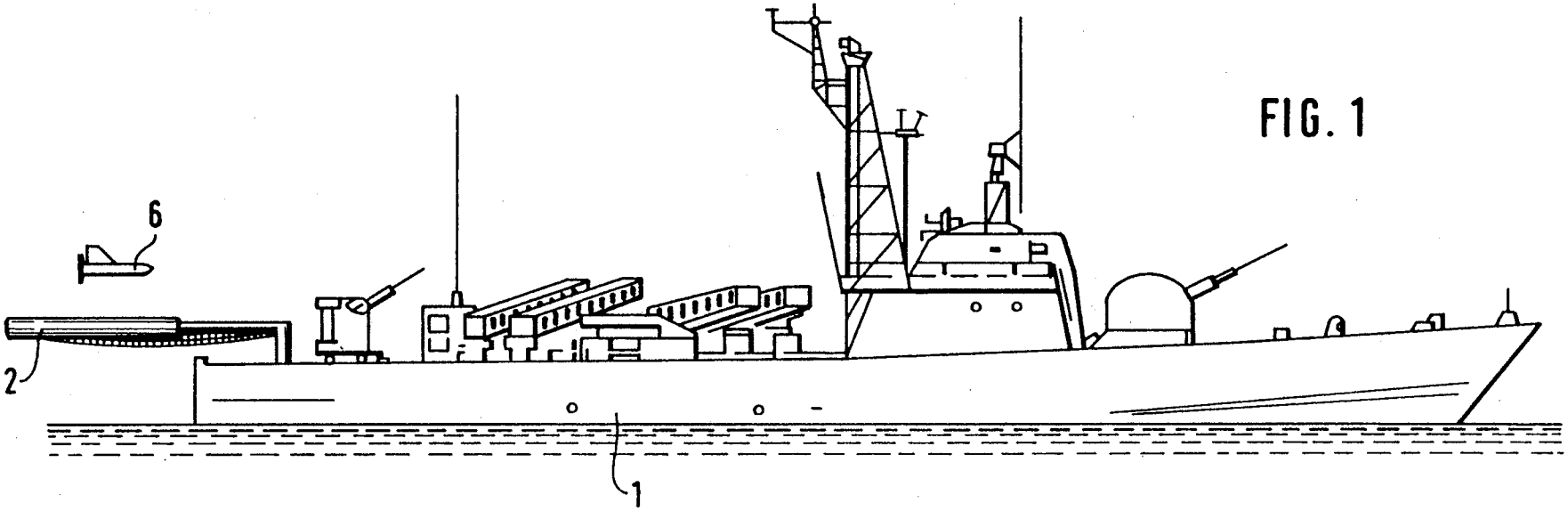
FIG. 1 is a side view of a warship with an extended retrieval surface or trampoline pursuant to the present invention.
Figure 2:
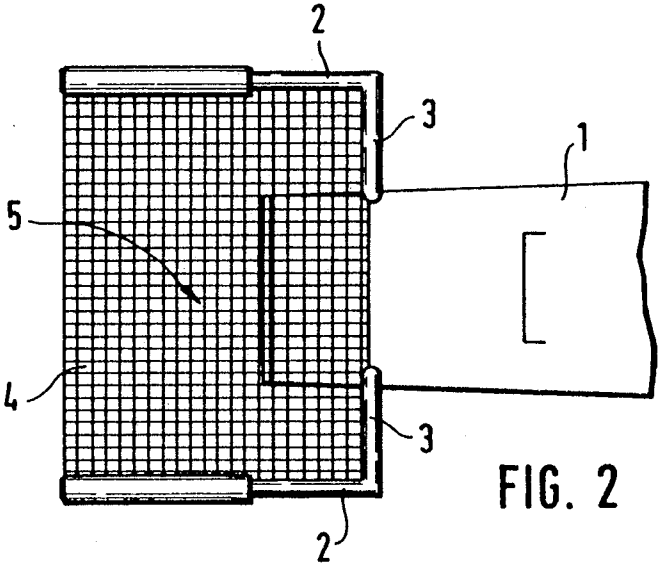
FIG. 2 is a partial plan view of FIG. 1.

In the illustrated design, retaining or bracing and guidance elements in the shape of a telescoping arrangement 2, extendable toward the rear, are placed in the stern region of a warship 1. The elements can additionally be folded out into the outer region by means of struts 3. These elements 2, 3 serve as a retention arrangement for a flexible surface element 4, in the form of a net, and constitute a trampoline-like retrieval surface 5.

Figure 4:
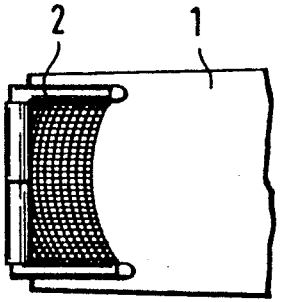
FIG. 4 is a plan view of FIG. 3.
Figure 3:
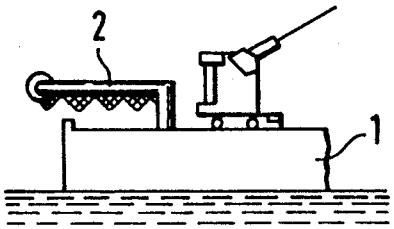
FIG. 3 is a side view of a stowed retrieval surface.

It is thus possible to form an appropriately large retrieval surface 5 on a warship 1 out the of the surface element 4 as a stored unit in FIGS. 3 and 4, stowed on the warship 1 so as to occupy a relatively small space and to return same again into its original location.

The retrieval surface 5 thus makes it possible to create a relatively large landing space for a drone 6, in order to receive the drone in a recovery phase by automatic or remotely controlled steering or control arrangements and additional auxiliary means, not shown here, such as a parachute. Thus, no precision landing is required and environmental conditions such as sea conditions and wind can also be dealt with satisfactorily in this manner.

While the invention has been illustrated and described as embodied in an apparatus for recovery of unmanned drones, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

1. An apparatus for recovering an unmanned reusable aircraft during a return phase in which landing occurs by remote control and the use of auxiliary means such as a parachute retrieval system, comprising: a flexible surface element (4) which is at least one of gatherable and foldable; and actuatable retaining and guidance means (2, 3) including two opposing L-shaped elements, the L-shaped elements each having a first leg that is extendable in a telescoping manner and a second leg that is pivotably mounted to a stern region of a ship so that the L-shaped elements are extendable in a longitudinal direction and outwardly pivotable for arranging the surface element horizontally beyond the stern region of the ship to form a trampoline-like retrieval surface (5) for the aircraft, and so that the L-shaped elements are longitudinally retractable and inwardly pivotable to form a stored stowage unit together with the surface element.

* * * * *